US011545109B2

(12) United States Patent
Chen

(10) Patent No.: US 11,545,109 B2
(45) Date of Patent: Jan. 3, 2023

(54) DISPLAY BACKLIGHT CONTROL METHOD

(71) Applicant: REALTEK SEMICONDUCTOR CORPORATION, Hsinchu (TW)

(72) Inventor: Li-Ang Chen, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 17/383,783

(22) Filed: Jul. 23, 2021

(65) Prior Publication Data

US 2022/0148535 A1 May 12, 2022

(30) Foreign Application Priority Data

Nov. 11, 2020 (TW) ..... 109139372

(51) Int. Cl.
*G09G 5/10* (2006.01)
*G09G 3/34* (2006.01)

(52) U.S. Cl.
CPC ..... *G09G 5/10* (2013.01); *G09G 3/3406* (2013.01); *G09G 2310/0237* (2013.01)

(58) Field of Classification Search
CPC ..... G09G 5/10; G09G 3/3406; G09G 2310/0237; G09G 2340/0435
See application file for complete search history.

(56) References Cited

U.S. PATENT DOCUMENTS 11,120,771 B2 * 9/2021 Callway ..... G06T 15/506
2015/0109286 A1 * 4/2015 Verbeure ..... G09G 3/3406 345/545
2022/0051634 A1 * 2/2022 Hong ..... G09G 3/3406

FOREIGN PATENT DOCUMENTS

TW I727593 5/2021

OTHER PUBLICATIONS

Display-Corner "Combining variable refresh rate and strobed backlight", Aug. 19, 2020, https://display-corner.epfl.ch/index.php/Combining_variable_refresh_r.

* cited by examiner

*Primary Examiner* — Antonio Xavier
(74) *Attorney, Agent, or Firm* — WPAT, PC

(57) ABSTRACT

Disclosed is a display backlight control method for adapting a display backlight source to multiple refresh rates. The method includes: ascertaining a relation between a refresh rate and a threshold; if the relation indicates that the refresh rate changes from being higher than the threshold to lower than the threshold, transmitting a first mode backlight control signal to make the display backlight source provide a first transitional backlight in a first transition period and then provide a constant backlight; and if the relation indicates that the refresh rate changes from being lower than the threshold to higher than the threshold, transmitting a second mode backlight control signal to make the display backlight source provide a second transitional backlight in a second transition period and then provide a non-transitional strobe backlight. The first (second) transitional backlight includes a first (second) transitional strobe backlight and a first (second) transitional constant backlight.

20 Claims, 10 Drawing Sheets

DISPLAY BACKLIGHT CONTROL METHOD

BACKGROUND OF THE INVENTION

1. Field of the Invention

The present disclosure relates to a display backlight control method, especially to a backlight control method applicable to a hold-type display.

2. Description of Related Art

When a hold-type display (e.g., an LCD monitor) shows a moving object, a viewer will notice that the image of the moving object is blurred due to a visual staying phenomenon, and this is called "motion blur".

In order to prevent the motion blur, a general prior art quickly turns on and then turns off a backlight module of a hold-type display so as to generate a black insertion effect, and this is called "strobe backlight technology". The strobe backlight technology turns on a display backlight source within a little part of a frame time and turns off the display backlight source within the remaining part of the frame time, so that the visual staying phenomenon is mitigated. The principle of a general strobe backlight technology is illustrated with FIG. 1 by a timeline, wherein the definitions of the vertical synchronization signal (V-Sync), the back-porch, the active region, the front-porch, etc., in FIG. 1 are well known in this technical field and not explained in detail here. As shown in FIG. 1, each strobe backlight (i.e., the dotted horizontal bars in the right side of FIG. 1) lasts for the same period of time, and usually appears after the update of a current frame and disappears before the update of a next frame; accordingly, a viewer can see each frame in a very short period of time and the visual staying phenomenon is mitigated.

Modern image display technologies include a variable refresh rate (VRR)/dynamic refresh rate (DRR) technology, and this technology does not limit the refresh rate of frames to a constant refresh rate and allows the refresh rate to vary with input signals (i.e., the content of frames). However, the VRR/DRR technology and the aforementioned strobe backlight technology cannot coexist in a straight manner; for example, in a circumstance that the refresh rate becomes lower as the input signals vary with time or the interval between two adjacent V-Syncs becomes longer, if each strobe backlight still appears at a time point right before the update of a next frame as shown in FIG. 2, the interval between two adjacent strobe backlights will become longer due to the variation in the refresh rate, and this will lead to an inconsistent luminance problem or a flickering problem.

Although some technical literatures discuss how to solve the aforementioned problems, these literatures do not go deep into improvements in user experience.

SUMMARY OF THE INVENTION

An object of the present disclosure is to provide a display backlight control method as improvements over the prior art.

An embodiment of the display backlight control method of the present disclosure is for adapting a display backlight source to multiple refresh rates. This embodiment includes the following steps: ascertaining a relation between a refresh rate and a predetermined threshold; if the relation indicates that a state of the refresh rate changes from a first state to a second state, transmitting a low-refresh-rate mode backlight control signal to request the display backlight source to provide a high-to-low transitional backlight in a high-to-low transition period and then provide a non-transitional constant backlight, wherein in the first state the refresh rate is higher than the predetermined threshold and in the second state the refresh rate is lower than the predetermined threshold, the high-to-low transitional backlight includes a high-to-low transitional strobe backlight and a high-to-low transitional constant backlight; and if the relation indicates that the state of the refresh rate changes from the second state to the first state, transmitting a high-refresh-rate mode backlight control signal to request the display backlight source to provide a low-to-high transitional backlight in a low-to-high transition period and then provide a non-transitional strobe backlight, wherein the low-to-high transitional backlight includes a low-to-high transitional strobe backlight and a low-to-high transitional constant backlight. In an exemplary implementation, the change of the high-to-low transitional backlight is opposite to the change of the low-to-high transitional backlight. In an exemplary implementation, at least one of the high-to-low transitional strobe backlight and the low-to-high transitional strobe backlight includes multiple kinds of strobe backlights in a timeline, and the durations of the multiple kinds of strobe backlights are different. In an exemplary implementation, the durations of the multiple kinds of strobe backlights are in increasing order or in decreasing order in the timeline.

These and other objectives of the present invention will no doubt become obvious to those of ordinary skill in the art after reading the following detailed description of the preferred embodiments that are illustrated in the various figures and drawings.

DETAILED DESCRIPTION OF THE PREFERRED EMBODIMENTS

The present specification discloses a display backlight control method. The method can adapt a display backlight source to multiple refresh rates and is applicable to a hold-type display such as an LCD monitor. The method can mitigate the motion blur and can prevent an inconsistent luminance problem or a flickering problem. The method can be in the form of firmware and/or software, and can be performed by a known/self-developed display control circuit. The said display control circuit includes a scaler/driver integrated circuit such as the control circuit disclosed in the TW patent (patent no. I727593). People having ordinary skill in the art can appreciate that "refresh rate" in the present specification means how many times a display updates the frame appeared on a screen of the display per unit time.

Figure 1:
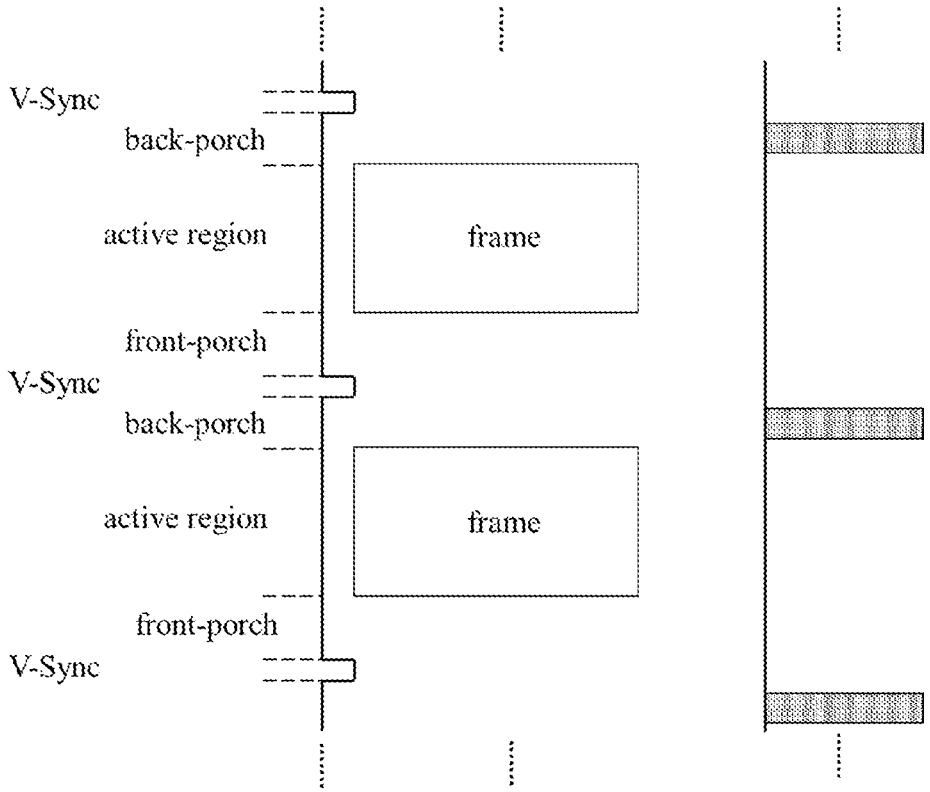
Fig. 1 (Prior Art)
FIG. 1 shows the principle of a general strobe backlight technology.
Figure 2:
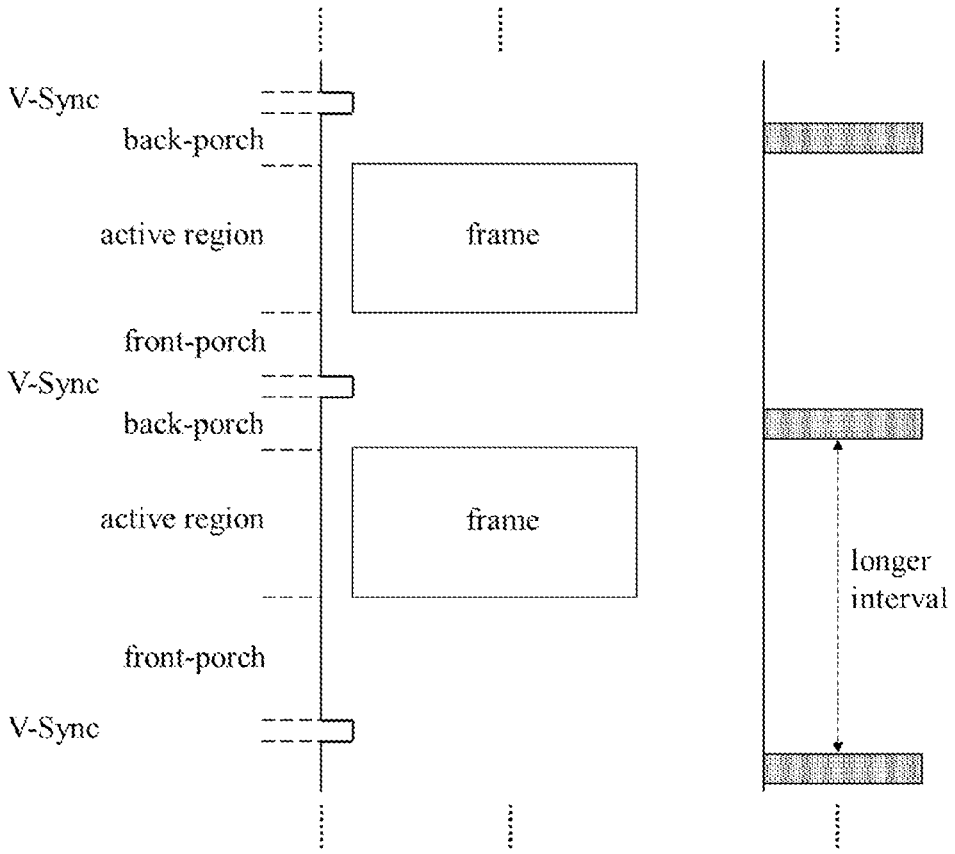
Fig. 2 (Prior Art)
FIG. 2 shows an inconsistent luminance problem or a flicking problem caused by the variation in the interval between two adjacent strobe backlights.
Figure 3:
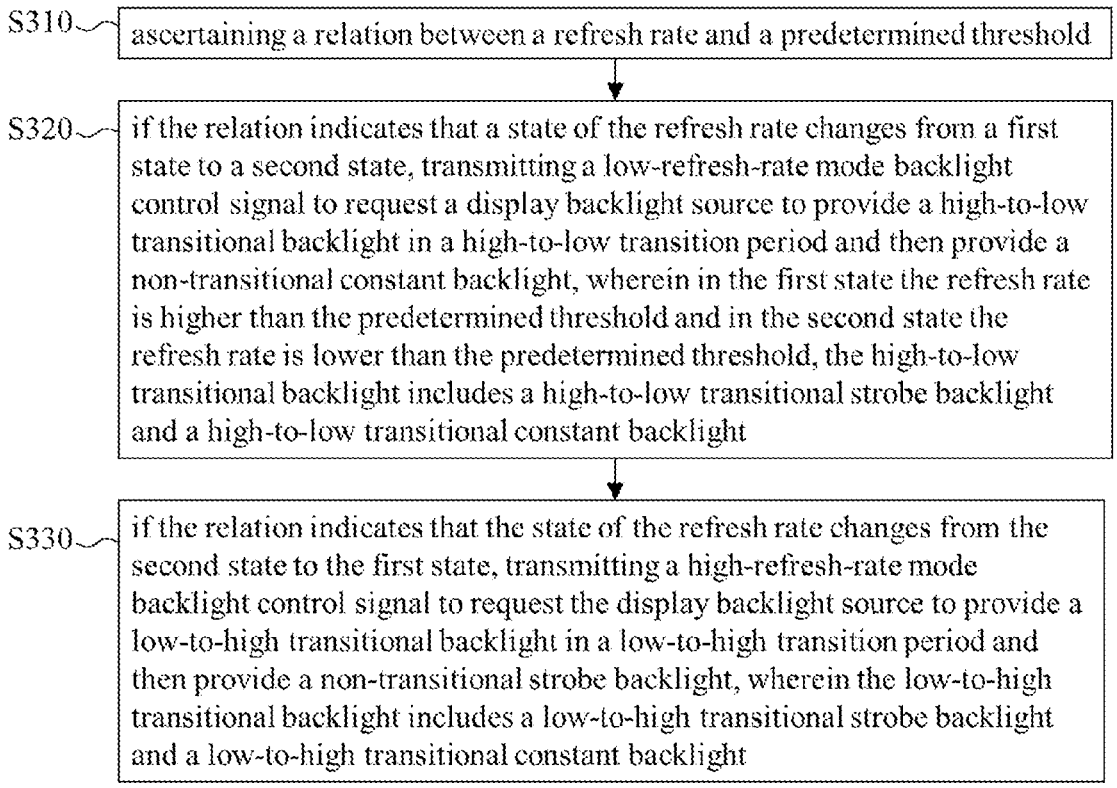
FIG. 3 shows an embodiment of the display backlight control method of the present disclosure.

FIG. 3 shows an embodiment of the display backlight control method of the present disclosure. The embodiment of FIG. 3 is for adapting a display backlight source to multiple refresh rates, and includes the following steps:

S310: a relation between a refresh rate and a predetermined threshold is ascertained. Generally, the predetermined threshold is not lower than the maximum flicker rate that can be perceived by human eyes. For example, the predetermined threshold is 75 Hz.

S320: if the relation indicates that a state of the refresh rate changes from a first state to a second state, a low-refresh-rate mode backlight control signal is transmitted to request the display backlight source to provide a high-to-low transitional backlight in a high-to-low transition period and then provide a non-transitional constant backlight, wherein in the first state the refresh rate is higher than the predetermined threshold and in the second state the refresh rate is lower than the predetermined threshold, the high-to-low transitional backlight includes a high-to-low transitional strobe backlight and a high-to-low transitional constant backlight. The detail of this step is described in a later paragraph.

S330: if the relation indicates that the state of the refresh rate changes from the second state to the first state, a high-refresh-rate mode backlight control signal is transmitted to request the display backlight source to provide a low-to-high transitional backlight in a low-to-high transition period and then provide a non-transitional strobe backlight, wherein the low-to-high transitional backlight includes a low-to-high transitional strobe backlight and a low-to-high transitional constant backlight. The detail of this step is described in a later paragraph.

Figure 4A:
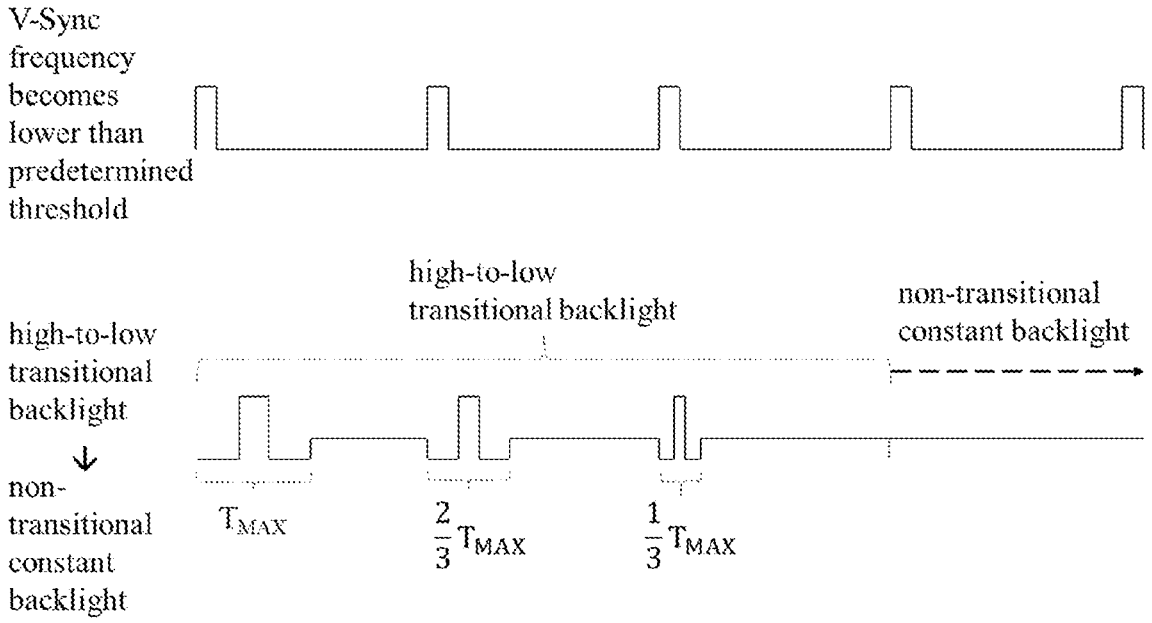
FIG. 4*a* shows an embodiment of the high-to-low transitional backlight and non-transitional constant backlight mentioned in FIG. 3.

FIG. 4*a* shows an embodiment of the high-to-low transitional backlight and non-transitional constant backlight mentioned in the step S320 of FIG. 3. As shown in FIG. 4*a*, the high-to-low transitional strobe backlight of the high-to-low transitional backlight includes K kinds of strobe backlights, wherein the K is an integer greater than one. Regarding each of the K kinds of strobe backlights in the high-to-low transition period, the display backlight source is turned off in a front black-insertion duration and a back black-insertion duration and the strobe backlight is provided right between the front black-insertion duration and the back black-insertion duration; the front black-insertion duration, the duration of the strobe backlight, and the back black-insertion duration are in a row; and the high-to-low transitional constant backlight is provided between the back black-insertion duration and a front black-insertion duration of a next strobe backlight. In addition, the durations of the K kinds of strobe backlights are different; more specifically, these durations are in decreasing order in a timeline (e.g., $T_{MAX}$, $\frac{2}{3}T_{MAX}$, and $\frac{1}{3}T_{MAX}$, wherein the definition of $T_{MAX}$ is described in a later paragraph). Regarding the K kinds of strobe backlights, the duration of an earlier strobe backlight is longer than the duration of a later strobe backlight so that a viewer can adapt herself/himself to the variation in backlights.

It is noted that in the high-to-low transition period of FIG. 4*a*, the sum ($T_{MAX}$) of the duration of the earliest strobe backlight, the front black-insertion duration prior to the earliest strobe backlight, and the back black-insertion duration following the earliest strobe backlight can be set according to the demand for implementation. For example, the sum can be equal to the reciprocal of the maximum refresh rate of the aforementioned multiple refresh rates (i.e., the minimum refresh period of multiple refresh periods corresponding to the multiple refresh rates)

$$\left(\text{e.g., } \frac{1}{144\text{ Hz}}\right).$$

It is also noted that before the high-to-low transition period, the embodiment of FIG. 3 can request the display backlight source to provide backlights according to the demand for implementation; for example, before the high-to-low transition period, the embodiment of FIG. 3 requests the display backlight source to repeatedly provide backlights as follows: a front black-insertion (i.e., zero backlight here) prior to a non-transitional strobe backlight, the non-transitional strobe backlight (e.g., a strobe backlight equivalent to the earliest strobe backlight in FIG. 4*a*), a back black-insertion (i.e., zero backlight here) following the non-transitional strobe backlight, and a non-transitional constant backlight.

Figure 4B:
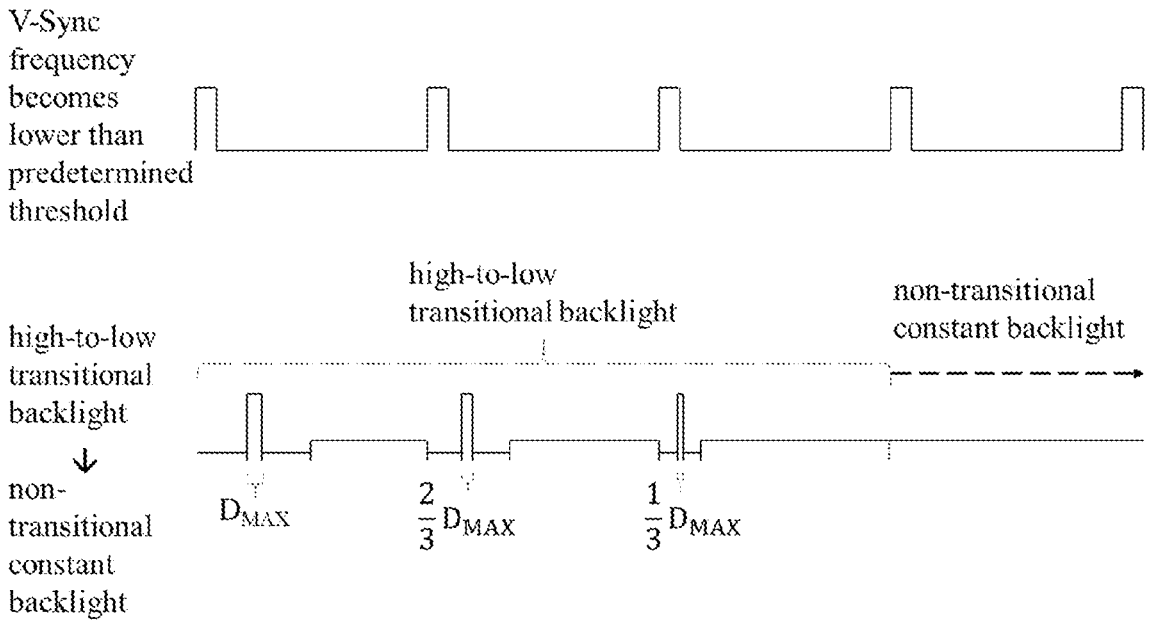
FIG. 4*b* shows another embodiment of the high-to-low transitional backlight and non-transitional constant backlight mentioned in FIG. 3.

FIG. 4*b* shows another embodiment of the high-to-low transitional backlight and non-transitional constant backlight mentioned in the step S320 of FIG. 3. In the embodiment of FIG. 4*b*, the display backlight source is not completely turned off in the front and back black-insertion durations of the high-to-low transition period; therefore, in comparison with the embodiment of FIG. 4*a*, a non-zero backlight exists in the front and back black-insertion durations neighboring to the duration of a strobe backlight (e.g., any of $D_{MAX}$, $\frac{2}{3}D_{MAX}$, and $\frac{1}{3}D_{MAX}$) in FIG. 4*b*, but the luminance of this non-zero backlight is weaker than the luminance of the high-to-low transitional constant backlight. It is noted that in order to achieve a better visual effect, in FIG. 4*a* or 4*b* the average backlight luminance (i.e., the average luminance of the strobe backlights and the backlights provided in the front and back black-insertion durations) within the high-to-low transition period can optionally be equal to the luminance of the non-transitional constant backlight; but the present invention is not limited thereto. It is also noted that the duration of the earliest strobe backlight (i.e., $D_{MAX}$) in the high-to-low transition period of FIG. 4*b* can be set according to the demand for implementation; for example, the duration of the earliest strobe backlight is equal to a quarter of the reciprocal $$\left(\text{e.g., } \frac{1}{144\text{ Hz}}\right)$$

of the maximum rate of the aforementioned multiple refresh rates (i.e., the minimum refresh period of the multiple refresh periods corresponding to the multiple refresh rates). It is further noted that the durations (e.g., $D_{MAX}$, $\frac{2}{3}D_{MAX}$, and $\frac{1}{3}D_{MAX}$) of the strobe backlights in the high-to-low transition period of FIG. 4*b* are in decreasing order in a timeline. It is further noted that each strobe backlight in FIG.

4a/4b may be repeated several times in the high-to-low transition period according to the demand for implementation.

Figure 5A:
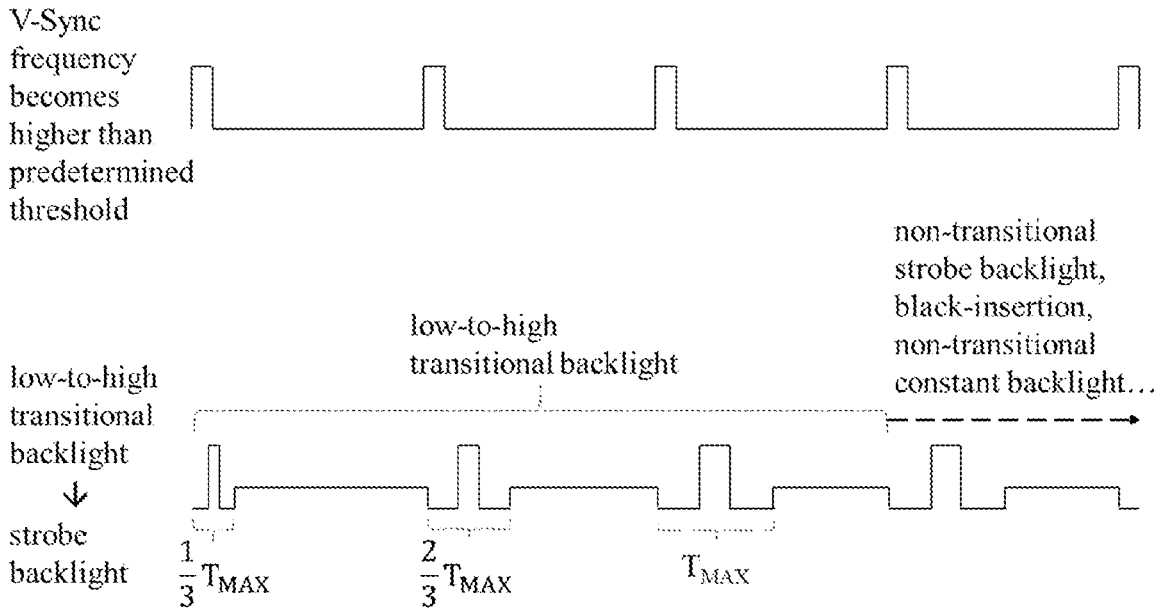
FIG. 5*a* shows an embodiment of the low-to-high transitional backlight and non-transitional constant backlight mentioned in FIG. 3.

FIG. 5a shows an embodiment of the low-to-high transitional backlight and non-transitional strobe backlight mentioned in FIG. 3. As shown in FIG. 5a, the low-to-high transitional strobe backlight of the low-to-high transitional backlight includes K kinds of strobe backlights, wherein the K is an integer greater than one. Regarding each of the K kinds of strobe backlights in the low-to-high transition period, the display backlight source is turned off in a front black-insertion duration and a back black-insertion duration and the strobe backlight is provided just between the front black-insertion duration and the back black-insertion duration; the front black-insertion duration, the duration of the strobe backlight, and the back black-insertion duration are in a row; and the low-to-high transitional constant backlight is provided between the back black-insertion duration and a front black-insertion duration of a next strobe backlight. In addition, the durations of the K kinds of strobe backlights are different; more specifically, these durations are in increasing order in a timeline (e.g., $\frac{1}{3}T_{MAX}$, $\frac{2}{3}T_{MAX}$, and $T_{MAX}$, wherein the definition of $T_{MAX}$ is described in a later paragraph). Regarding the K kinds of strobe backlights, the duration of an earlier strobe backlight is shorter than the duration of a later strobe backlight so that a viewer can adapt herself/himself to the variation in backlights.

It is noted that in the low-to-high transition period of FIG. 5a, the sum ($T_{MAX}$) of the duration of the latest strobe backlight, the front black-insertion duration prior to the latest strobe backlight, and the back black-insertion duration following the latest strobe backlight can be determined according to the demand for implementation. For example, the sum can be equal to the reciprocal of the maximum refresh rate of the aforementioned multiple refresh rates (i.e., the minimum refresh period of the multiple refresh periods corresponding to the multiple refresh rates)

$$\left(\text{e.g., } \frac{1}{144\text{ Hz}}\right).$$

it is also noted that before the low-to-high transition period, the embodiment of FIG. 3 can request the display backlight source to provide backlights according to the demand for implementation; for example, before the low-to-high transition period, the embodiment of FIG. 3 requests the display backlight source to continuously provide the non-transitional constant backlight. It is further noted that after the low-to-high transition period, the embodiment of FIG. 3 can request the display backlight source to provide the backlights according to the demand for implementation; for example, after the low-to-high transition period, the embodiment of FIG. 3 requests the display back light source to repeatedly provide backlights as follows: a front black-insertion (i.e., zero backlight here) prior to a non-transitional strobe backlight, the non-transitional strobe backlight (e.g., a strobe backlight equivalent to the latest strobe backlight in FIG. 5a), a back black-insertion (i.e., zero backlight here) following the non-transitional strobe backlight, and a non-transitional constant backlight, wherein the sum of the duration of the front black-insertion, the duration of the non-transitional strobe backlight, and the duration of the back black-insertion is equal to $T_{MAX}$.

Figure 5B:
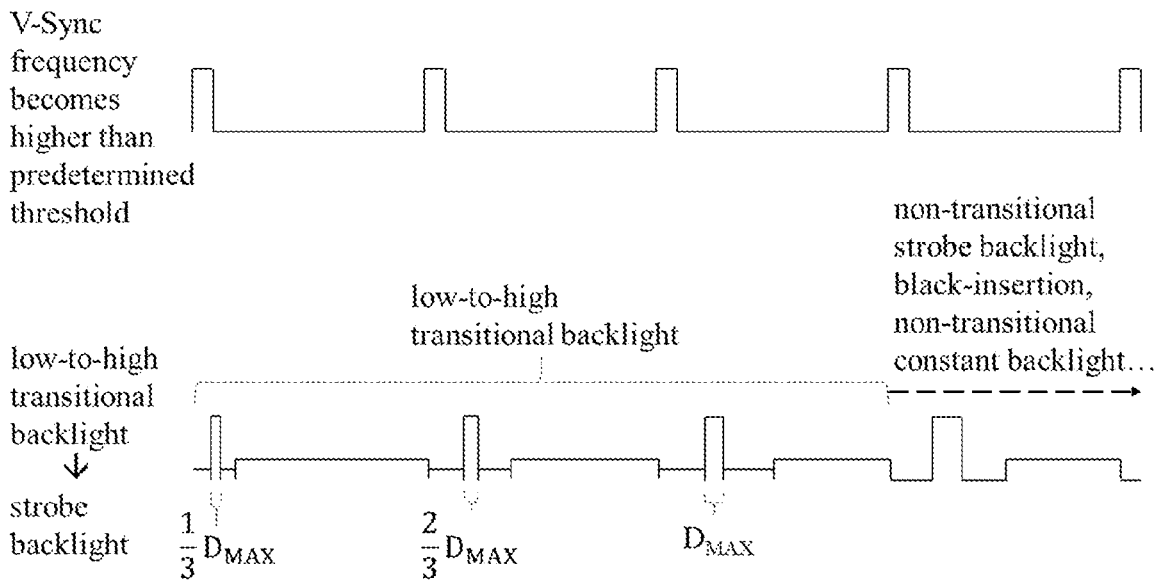
FIG. 5*b* shows another embodiment of the low-to-high transitional backlight and non-transitional constant backlight mentioned in FIG. 3.

FIG. 5b shows another embodiment of the low-to-high transitional backlight and non-transitional constant backlight mentioned in FIG. 3. In the embodiment of FIG. 5b, the display backlight source is not completely turned off in the front and back black-insertion durations of the low-to-high transition period; therefore, in comparison with the embodiment of FIG. 5a, a non-zero backlight exists in the front and back black-insertion durations neighboring to the duration of a strobe backlight (e.g., any of $\frac{1}{3}D_{MAX}$, $\frac{2}{3}D_{MAX}$, and $D_{MAX}$) in FIG. 5b, but the luminance of the non-zero backlight is weaker than the luminance of the low-to-high transitional constant backlight. It is noted that in order to achieve a better visual effect, in FIG. 5a or 5b the average backlight luminance (i.e., the average luminance of the strobe backlights and the backlights provided in the front and back black-insertion durations) within the low-to-high transition period can optionally be equal to the luminance of the non-transitional constant backlight; but the present invention is not limited thereto. It is also noted that the duration of the latest strobe backlight (i.e., $D_{MAX}$) in the low-to-high transition period of FIG. 5b can be determined according to the demand for implementation; for example, the duration of the latest strobe backlight is equal to a quarter of the reciprocal $$\left(\text{e.g., } \frac{1}{144\text{ Hz}}\right)$$

of the maximum rate of the aforementioned multiple refresh rates (i.e., the minimum refresh period of the multiple refresh periods corresponding to the multiple refresh rates). It is further noted that the durations (e.g., $\frac{1}{3}D_{MAX}$, $\frac{2}{3}D_{MAX}$, and $D_{MAX}$) of the strobe backlights in the low-to-high transition period of FIG. 5b are in increasing order in a timeline. It is further noted that each strobe backlight in FIG. 5a/5b may be repeated several times in the low-to-high transition period according to the demand for implementation.

Please note that the embodiments of FIGS. 4a~4b and 5a~5b are for understanding rather than for restriction of the present invention. Please also note that people having ordinary skill in the art can derive the modifications of the aforementioned K kinds of strobe backlights in view of the present disclosure.

Please refer to FIGS. 4a~4b and 5a~5b. In the embodiments of these figures, both the luminance peak value of the high-to-low transitional constant backlight and the luminance peak value of the low-to-high transitional constant backlight are the same as the luminance peak value of the non-transitional constant backlight; both the luminance peak value of the high-to-low transitional strobe backlight and the luminance peak value of the low-to-high transitional strobe backlight are the same as the luminance peak value of the non-transitional strobe backlight; the change of the high-to-low transitional backlight in a timeline is opposite to the change of the low-to-high transitional backlight in the timeline; and the maximum duration of the durations of the aforementioned K kinds of strobe backlights is not longer than the duration of the non-transitional strobe backlight. The above-mentioned features can be used optionally, and they are not the restrictions of the present invention.

Figure 4C:
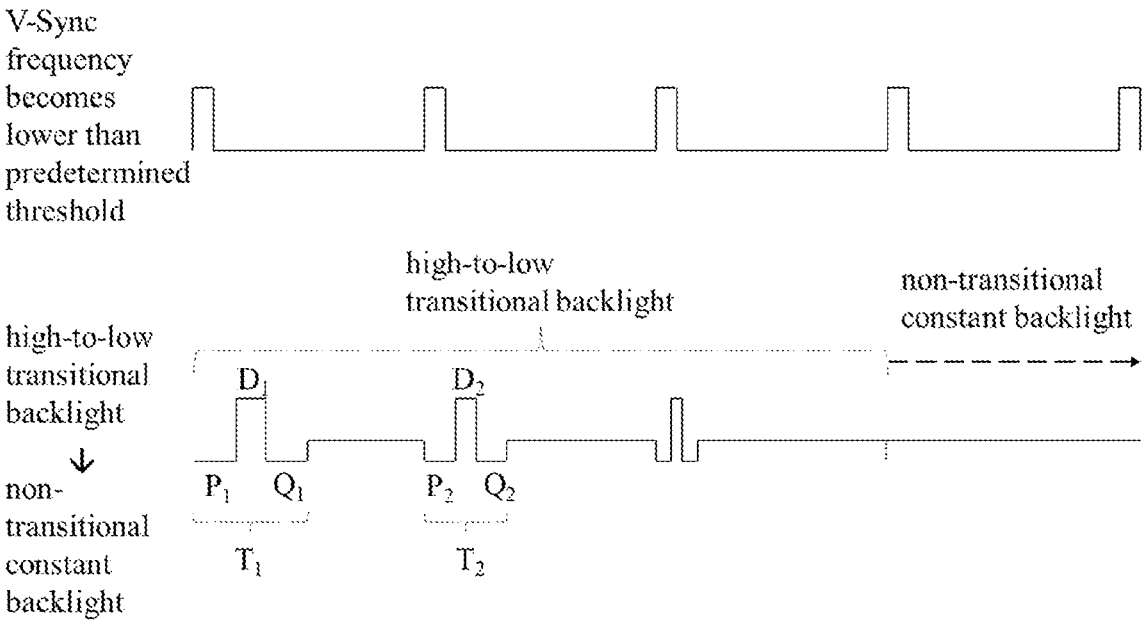
FIG. 4*c* shows that the durations of strobe backlights and the durations of black insertion in FIG. 4*a* change by a specific ratio.
Figure 5C:
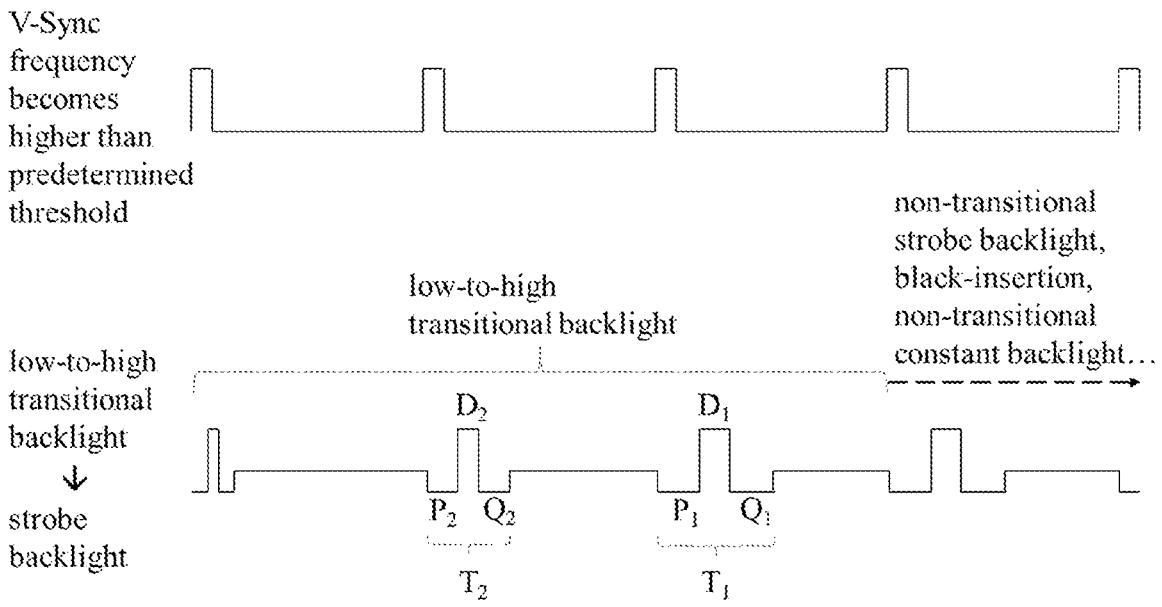
FIG. 5*c* shows that the durations of strobe backlights and the durations of black insertion in FIG. 5*a* change by a specific ratio.

Please refer to FIG. 4a in view of FIG. 4c or refer to FIG. 5a in view of FIG. 5c. In the high-to-low transition period of FIG. 4c (or alternatively, in the low-to-high transition period of FIG. 5c), the multiple kinds of strobe backlights include a first strobe backlight and a second strobe backlight; the display backlight source is turned off in a first front black-insertion duration and a first back black-insertion duration, and the first strobe backlight is provided right between the first front black-insertion duration and the first back black-insertion duration; the display backlight source is turned off in a second front black-insertion duration and a second back black-insertion duration, and the second strobe backlight is provided right between the second front black-insertion duration and the second back black-insertion duration; the first front black-insertion duration (e.g., $P_1$ in FIG. 4*c* or $P_2$ in FIG. 5*c*), the duration of the first strobe backlight (e.g., $D_1$ in FIG. 4*c* or $D_2$ in FIG. 5*c*), and the first back black-insertion duration (e.g., $Q_1$ in FIG. 4*c* or $Q_2$ in FIG. 5*c*) are in a row; the second front black-insertion duration (e.g., $P_2$ in FIG. 4*c* or $P_1$ in FIG. 5*c*), the duration of the second strobe backlight (e.g., $D_2$ in FIG. 4*c* or $D_1$ in FIG. 5*c*), and the second back black-insertion duration (e.g., $Q_2$ in FIG. 4*c* or $Q_1$ in FIG. 5*c*) are in a row; the sum of the first front black-insertion duration, the duration of the first strobe backlight, and the first back black-insertion duration is equal to a first total time (e.g., $P_1+D_1+Q_1=T_1$ in FIG. 4*c* or $P_2+D_2+Q_2=T_2$ in FIG. 5*c*); the sum of the second front black-insertion duration, the duration of the second strobe backlight, and the second back black-insertion duration is equal to a second total time (e.g., $P_2+D_2+Q_2=T_2$ in FIG. 4*c* or $P_1+D_1+Q_1=T_1$ in FIG. 5*c*); the ratio of the duration of the first strobe backlight to the first total time (e.g., $$\frac{D_1}{T_1}$$

in FIG. 4*c* or $$\frac{D_2}{T_2}$$

in FIG. 5*c*) is equal to the ratio of the duration of the second strobe backlight to the second total time (e.g., $$\frac{D_2}{T_2}$$

in FIG. 4*c* or $$\frac{D_1}{T_1}$$

in FIG. 5*c*); the ratio of the first front black-insertion duration to the first total time $$\left(\text{e.g., } \frac{P_1}{T_1}\right.$$

in FIG. 4*c* or $$\frac{P_2}{T_2}$$

in FIG. 5C) is equal to the ratio of the second front black-insertion duration to the second total time $$\left(\text{e.g., } \frac{P_2}{T_2}\right.$$

in FIG. 4C or $$\frac{P_1}{T_1}$$

in FIG. 5*c*). The maximum refresh rate of the aforementioned multiple refresh rates is corresponding to the minimum refresh period; in FIG. 4*c* the first strobe backlight is provided first, the first total time (i.e., $T_1$ in FIG. 4*c*) is equal to the minimum refresh period, and the second total time (i.e., $T_2$ in FIG. 4*c*) is shorter than the minimum refresh period; in FIG. 5*c* the second strobe backlight is provided latest, the second total time (i.e., $T_1$ in FIG. 5*c*) is equal to the minimum refresh period, and the first total time (i.e., $T_2$ in FIG. 5*c*) is shorter than the minimum refresh period.

Figure 6:
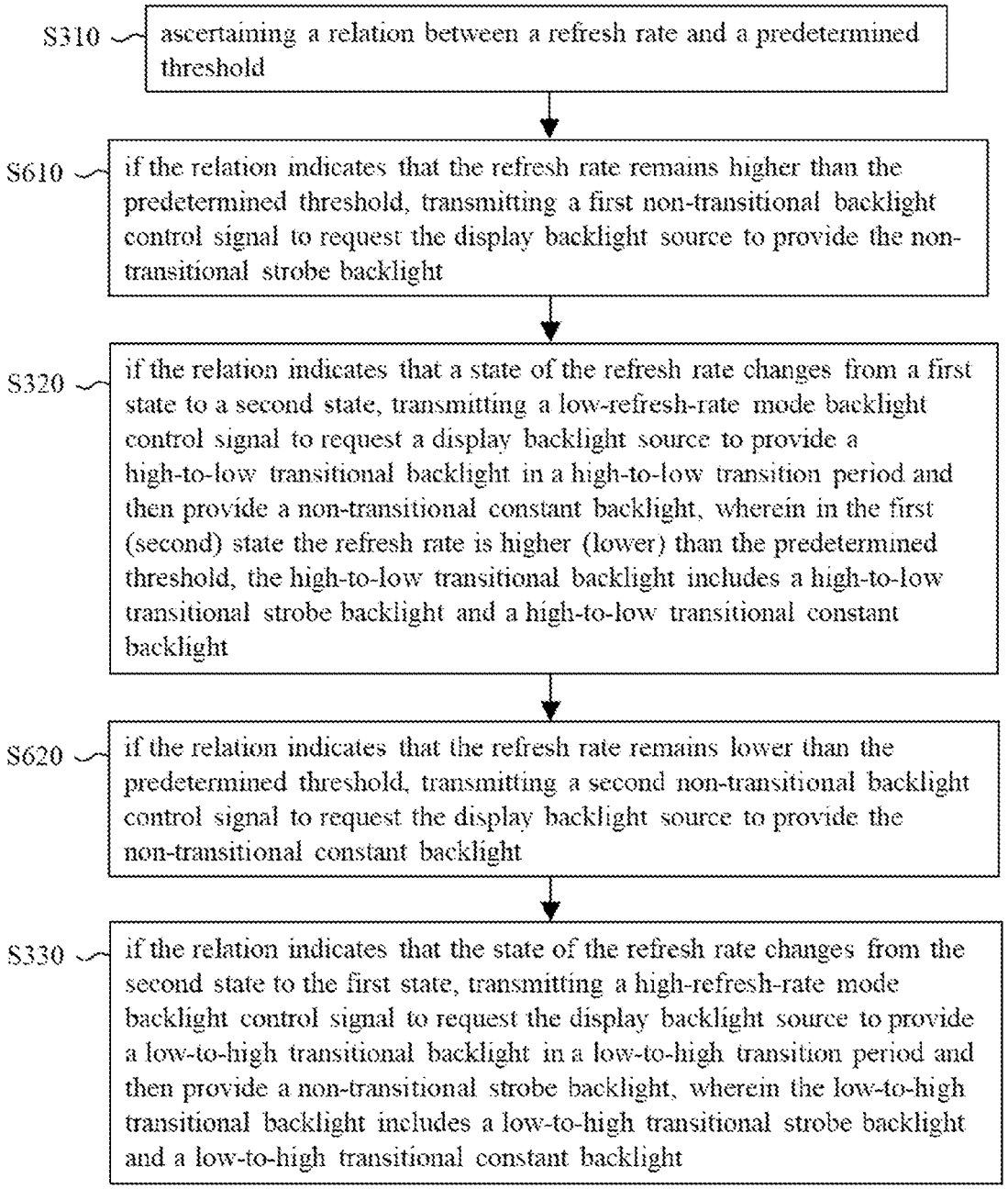
FIG. 6 shows another embodiment of the display backlight control method of the present disclosure.

FIG. 6 shows another embodiment of the display backlight control method of the present disclosure. In comparison with FIG. 3, the embodiment of FIG. 6 further includes the following steps:

S610: if the relation indicates that the refresh rate remains higher than the predetermined threshold, a first non-transitional backlight control signal is transmitted to request the display backlight source to provide the non-transitional strobe backlight. For example, the step S610 requests the display backlight source to repeatedly provide backlights as follows: a front black-insertion (i.e., zero backlight, or a low luminance backlight) prior to a non-transitional strobe backlight, the non-transitional strobe backlight, a back black-insertion (i.e., zero backlight, or a low luminance backlight) following the non-transitional strobe backlight, and a non-transitional constant backlight.

S620: if the relation indicates that the refresh rate remains lower than the predetermined threshold, a second non-transitional backlight control signal is transmitted to request the display backlight source to provide the non-transitional constant backlight.

It is noted that the steps in FIG. 3/6 are not limited to specific order, if practicable. It is also noted that people having ordinary skill in the art can selectively use some or all of the features of any embodiment in this specification or selectively use some or all of the features of multiple embodiments in this specification to implement the present invention as long as such implementation is practicable; in other words, the present invention can be carried out flexibly in accordance with the present disclosure.

To sum up, the display backlight control method of the present disclosure can adapt a display backlight source to multiple refresh rates, and this can mitigate the motion blur problem and can prevent the inconsistent luminance problem or flickering problem.

The aforementioned descriptions represent merely the preferred embodiments of the present invention, without any intention to limit the scope of the present invention thereto. Various equivalent changes, alterations, or modifications based on the claims of the present invention are all consequently viewed as being embraced by the scope of the present invention.

What is claimed is:

1. A display backlight control method for adapting a display backlight source to multiple refresh rates, the method comprising:

ascertaining a relation between a refresh rate and a predetermined threshold;

when the relation indicates that a state of the refresh rate changes from a first state to a second state, transmitting a low-refresh-rate mode backlight control signal to request the display backlight source to provide a high-to-low transitional backlight in a high-to-low transition period and then provide a non-transitional constant backlight, wherein in the first state the refresh rate is higher than the predetermined threshold and in the second state the refresh rate is lower than the predetermined threshold, the high-to-low transitional backlight includes a high-to-low transitional strobe backlight and a high-to-low transitional constant backlight; and when the relation indicates that the state of the refresh rate changes from the second state to the first state, transmitting a high-refresh-rate mode backlight control signal to request the display backlight source to provide a low-to-high transitional backlight in a low-to-high transition period and then provide a non-transitional strobe backlight, wherein the low-to-high transitional backlight includes a low-to-high transitional strobe backlight and a low-to-high transitional constant backlight.

2. The display backlight control method of claim 1, wherein a change of the high-to-low transitional backlight is opposite to a change of the low-to-high transitional backlight.

3. The display backlight control method of claim 1, wherein at least one of the high-to-low transitional strobe backlight and the low-to-high transitional strobe backlight includes multiple kinds of strobe backlights in a timeline, and durations of the multiple kinds of strobe backlights are different.

4. The display backlight control method of claim 3, wherein a maximum duration of the durations of the multiple kinds of strobe backlights is shorter than or equal to a duration of the non-transitional strobe backlight.

5. The display backlight control method of claim 3, wherein the durations of the multiple kinds of strobe backlights are in increasing order or in decreasing order in the timeline.

6. The display backlight control method of claim 5, wherein the high-to-low transitional strobe backlight comprises the multiple kinds of strobe backlights; and regarding the multiple kinds of strobe backlights, a duration of a first strobe backlight is longer than a duration of a second strobe backlight, and the first strobe backlight is provided before a provision of the second strobe backlight.

7. The display backlight control method of claim 6, wherein the low-to-high transitional strobe backlight includes the multiple kinds of strobe backlights; and regarding the multiple kinds of strobe backlights, a duration of a third strobe backlight is shorter than a duration of a fourth strobe backlight, and the third strobe backlight is provided before a provision of the fourth strobe backlight.

8. The display backlight control method of claim 5, wherein the low-to-high transitional strobe backlight includes the multiple kinds of strobe backlights; and regarding the multiple kinds of strobe backlights, a duration of a first strobe backlight is shorter than a duration of a second strobe backlight, and the first strobe backlight is provided before a provision of the second strobe backlight.

9. The display backlight control method of claim 5, wherein the multiple kinds of strobe backlights include a first strobe backlight and a second strobe backlight; the display backlight source is turned off in a first front black-insertion duration and a first back black-insertion duration, and the first strobe backlight is provided between the first front black-insertion duration and the first back black-insertion duration; the display backlight source is turned off in a second front black-insertion duration and a second back black-insertion duration, and the second strobe backlight is provided between the second front black-insertion duration and the second back black-insertion duration; the first front black-insertion duration, a duration of the first strobe backlight, and the first back black-insertion duration are in a row; the second front black-insertion duration, a duration of the second strobe backlight, and the second back black-insertion duration are in a row; a sum of the first front black-insertion duration, the duration of the first strobe backlight, and the first back black-insertion duration is equal to a first total time; a sum of the second front black-insertion duration, the duration of the second strobe backlight, and the second back black-insertion duration is equal to a second total time; a ratio of the duration of the first strobe backlight to the first total time is equal to a ratio of the duration of the second strobe backlight to the second total time; a ratio of the first front black-insertion duration to the first total time is equal to a ratio of the second front black-insertion duration to the second total time.

10. The display backlight control method of claim 9, wherein a maximum refresh rate of the multiple refresh rates is corresponding to a minimum refresh period; the high-to-low transitional strobe backlight includes the multiple kinds of strobe backlights; the first strobe backlight of the multiple kinds of strobe backlights is provided first; the first total time is equal to the minimum refresh period; and the second total time is shorter than the minimum refresh period.

11. The display backlight control method of claim 9, wherein a maximum refresh rate of the multiple refresh rates is corresponding to a minimum refresh period; the low-to-high transitional strobe backlight includes the multiple kinds of strobe backlights; the second strobe backlight of the multiple kinds of strobe backlights is provided last; the second total time is equal to the minimum refresh period; and the first total time is shorter than the minimum refresh period.

12. The display backlight control method of claim 5, wherein the multiple kinds of strobe backlights include a first strobe backlight and a second strobe backlight; the display backlight source is turned off in a first front black-insertion duration before a provision of the first strobe backlight; the display backlight source is turned off in a second front black-insertion duration before a provision of the second strobe backlight; the first front black-insertion duration and a duration of the first strobe backlight are successive; the second front black-insertion duration and a duration of the second strobe backlight are successive; a sum of the first front black-insertion duration and the duration of the first strobe backlight is equal to a first total time; a sum of the second front black-insertion duration and the duration of the second strobe backlight is equal to a second total time; a ratio of the first front black-insertion duration to the first total time is equal to a ratio of the second front black-insertion duration to the second total time.

13. The display backlight control method of claim 12, wherein the first total time is different from the second total time.

14. The display backlight control method of claim 5, wherein the multiple kinds of strobe backlights include a first strobe backlight and a second strobe backlight; the display backlight source is turned off in a first back black-insertion duration after a provision of the first strobe backlight; the display backlight source is turned off in a second back black-insertion duration after a provision of the second strobe backlight; a duration of the first strobe backlight and the first back black-insertion duration are successive; a duration of the second strobe backlight and the second back black-insertion duration are successive; a sum of the duration of the first strobe backlight and the first back black-insertion duration is equal to a first total time; a sum of the duration of the second strobe backlight and the second back black-insertion duration is equal to a second total time; a ratio of the first back black-insertion duration to the first total time is equal to a ratio of the second back black-insertion duration to the second total time.

15. The display backlight control method of claim 14, wherein the first total time is different from the second total time.

16. The display backlight control method of claim 1, wherein the high-refresh-rate mode backlight control signal requests the display backlight source to provide the non-transitional strobe backlight and the non-transitional constant backlight after the low-to-high transition period; the display backlight source is turned off in a front black-insertion duration and a back black-insertion duration, and the non-transitional strobe backlight is provided between the front black-insertion duration and the back black-insertion duration; after the low-to-high transition period, having the display backlight source provide the non-transitional constant backlight within a time except a duration of the non-transitional strobe backlight, the front black-insertion duration, and the back black-insertion duration.

17. The display backlight control method of claim 16, wherein a sum of the duration of the non-transitional strobe backlight, the front black-insertion duration, and the back black-insertion duration is equal to a total time; and the total time is equal to a minimum refresh period corresponding to a maximum refresh rate of the multiple refresh rates.

18. The display backlight control method of claim 1, further comprising:

if the relation indicates that the refresh rate remains higher than the predetermined threshold, transmitting a first non-transitional backlight control signal to request the display backlight source to provide the non-transitional strobe backlight; and if the relation indicates that the refresh rate remains lower than the predetermined threshold, transmitting a second non-transitional backlight control signal to request the display backlight source to provide the non-transitional constant backlight.

19. The display backlight control method of claim 1, wherein an average of luminance of the high-to-low transitional strobe backlight and luminance of the high-to-low transitional constant backlight is equal to luminance of the non-transitional constant backlight.

20. The display backlight control method of claim 1, wherein an average of luminance of the low-to-high transitional strobe backlight and luminance of the low-to-high transitional constant backlight is equal to luminance of the non-transitional constant backlight.

* * * * *